US010625139B2

(12) United States Patent
Tickner et al.

(10) Patent No.: US 10,625,139 B2
(45) Date of Patent: Apr. 21, 2020

(54) SNOWBOARD ATTACHMENT TO A STANDARD SNOWBOARD FOR RIDING UNDER POWDER SNOW CONDITIONS

(71) Applicant: ALLWINTER LIMITED, Chelmsford (GB)

(72) Inventors: William Tickner, Chelmsford (GB); Alice Green, Chelmsford (GB)

(73) Assignee: ALLWINTER LTD, Chelmsford (GB)

( * ) Notice: Subject to any disclaimer, the term of this patent is extended or adjusted under 35 U.S.C. 154(b) by 0 days.

(21) Appl. No.: 16/331,619

(22) PCT Filed: Sep. 8, 2017

(86) PCT No.: PCT/EP2017/025254
§ 371 (c)(1),
(2) Date: Mar. 8, 2019

(87) PCT Pub. No.: WO2018/046139
PCT Pub. Date: Mar. 15, 2018

(65) Prior Publication Data

US 2019/0192956 A1 Jun. 27, 2019

(30) Foreign Application Priority Data

Sep. 8, 2016 (GB) ..... 1615285.2

(51) Int. Cl.
*A63C 5/06* (2006.01)
*A63C 5/00* (2006.01)
(Continued)

(52) U.S. Cl.
CPC ..... *A63C 5/062* (2013.01); *A63C 5/006* (2013.01); *A63C 5/044* (2013.01); *A63C 5/0405* (2013.01); *A63C 5/03* (2013.01)

(58) Field of Classification Search
CPC ..... A63C 5/062; A63C 5/006; A63C 5/0405; A63C 5/044; A63C 5/0052; A63C 11/00
See application file for complete search history.

(56) References Cited

U.S. PATENT DOCUMENTS 1,595,632 A * 8/1926 Taft ..... A63C 5/062 280/601
3,066,326 A * 12/1962 Collins ..... A63C 5/062 441/68

(Continued)

FOREIGN PATENT DOCUMENTS

| | | |
|---|---|---|
| CA | 2882081 A1 | 8/2016 |
| DE | 2638928 A1 | 3/1978 |
| DE | 2835795 A1 | 2/1980 |

OTHER PUBLICATIONS

International Search Report received for International Patent Application No. PCT/GB2017/025254, dated Nov. 7, 2017, 6 pages.

(Continued)

*Primary Examiner* — John D Walters
*Assistant Examiner* — James J Triggs

(57) ABSTRACT

There is provided a snowboard attachment to a standard snowboard for riding under powder snow conditions. The snowboard attachment comprises a nose part, an elongate passage and a body part. The nose part is operable to attach to the standard snowboard for providing lift and float while riding on powder snow. The elongate passage has walls extending between an opening in a top surface of the snowboard attachment and an opening in a bottom surface of the snowboard attachment, and is orientated transverse to the longitudinal axis of the snowboard attachment. The walls of the elongate passage are configured to surround the standard snowboard. The body part is attached in operation to the nose part, and has clamp through openings. The clamp through openings are arranged to receive bolts of a binding (Continued)

clamp of the standard snowboard, such that the clamp through openings lie in operation between the binding clamp and the standard snowboard.

20 Claims, 22 Drawing Sheets

(51) Int. Cl.

| | |
|---|---|
| ***A63C 5/04*** | (2006.01) |
| ***A63C 5/044*** | (2006.01) |
| *A63C 5/03* | (2006.01) |

(56) References Cited

U.S. PATENT DOCUMENTS

| | | | | | |
|---|---|---|---|---|---|
| 3,804,428 | A * | 4/1974 | Amick | B62B 15/001 | 280/8 |
| 4,180,275 | A | 12/1979 | Montoya | | |
| 4,616,842 | A * | 10/1986 | Echevin | A63C 5/062 | 280/602 |
| 5,310,221 | A * | 5/1994 | Schmidt | A63C 5/062 | 280/809 |
| 5,435,589 | A * | 7/1995 | Fagot | A63C 5/052 | 280/610 |
| 6,079,746 | A | 6/2000 | Olsen | | |
| D474,131 | S * | 5/2003 | Lobson | D12/7 | |
| 6,945,563 | B2 * | 9/2005 | Clausing | A63C 5/052 | 280/809 |
| 8,052,165 | B2 * | 11/2011 | Holzer | A63C 5/052 | 280/608 |
| 8,286,988 | B2 * | 10/2012 | Jones | A63C 5/062 | 280/601 |
| 8,910,966 | B1 | 12/2014 | Rogers | | |
| 9,108,103 | B2 * | 8/2015 | Nobil | A63C 11/20 | |
| 9,656,724 | B2 * | 5/2017 | Bedard | B62B 17/02 | |
| 2016/0030830 | A1 | 2/2016 | Rice | | |

OTHER PUBLICATIONS

Murer, Michael; Written Opinion for International Patent Application No. PCT/GB2017/025254, dated Nov. 7, 2017, 10 pages.
Search Report received for United Kingdom Patent Application No. GB1615285.2, dated Sep. 10, 2018, 12 pages.

* cited by examiner

SNOWBOARD ATTACHMENT TO A STANDARD SNOWBOARD FOR RIDING UNDER POWDER SNOW CONDITIONS

TECHNICAL FIELD

The present disclosure relates generally to a snowboard accessory, and more specifically, to a snowboard attachment to a standard snowboard that is capable of providing improved lift and float while riding on powder snow.

BACKGROUND

Snowboarding is a popular recreational activity and also an Olympic and Paralympic sport that involves descending a snow-covered slope while standing on a snowboard that is attached to a rider's feet. Powder snow refers to freshly fallen, uncompacted snow that is light and dry, with low moisture content. Standard snowboards typically comprise a centered stance with a nose tip and a tail, wherein the nose tip and the tail are exact copies of each other, making them symmetrical in shape. There are various standard snowboards available on the market, and although they are essentially the same shape, they have a variety of different dimensions and binding arrangements. Powder snowboards comprise a large nose to create improved float for riding under powder snow conditions. While snowboarding under powder snow conditions, the standard snowboards have a tendency for their nose tips to become buried under snow; such burying of the nose tips is a technical problem. For many snowboarders and especially beginners there are problems with turning control. To counter this technical problem, a given snowboard rider may use a riding stance wherein the majority of weight of the snowboard rider is applied on the snowboard rider's trailing/aft leg and the snowboard rider applies an upward pull with the snowboard rider's leading foot. Such a riding stance creates a forward-tip-up and back-end down condition that is required to stay "afloat" in the powder snow while translating forward and particularly downhill. Moreover, such a stance may potentially cause a huge amount of muscle fatigue in the back leg of the snowboard rider. If this "nose-up" condition is lost, the standard snowboard will nose-dive into the powder snow, taking the rider down as well. Such a nose-dive causes falls, forward flips, and in extreme cases becoming completely submerged in the powder snow. All these conditions pose a danger to the snowboard rider.

Specialised powder snowboards are contemporarily commercially available for purchase to be used for riding under powder snow conditions. However, these commercially available powder snowboards are designed solely for riding under powder snow conditions by creating an improved float in the nose of the powder snowboards. Furthermore, these powder snowboards are far more expensive than standard snowboards, and since riding under perfect powder snow conditions is so rare, an average rider does not own a powder board.

Therefore, in view of aforementioned problems and drawbacks associated with known types of snowboards, there exists a need to address, for example to overcome, the aforementioned drawbacks in existing approaches for riding under powder snow conditions using aforesaid standard snowboards.

SUMMARY

The present disclosure seeks to provide a snowboard attachment to a standard snowboard for riding under powder snow conditions.

In a first embodiment, the disclosure provides a snowboard attachment comprising: a nose part that is operable to attach to the standard snowboard for providing lift and float while riding on powder snow; an elongate passage in the snowboard attachment having walls extending between an opening in a top surface of the snowboard attachment and an opening in a bottom surface of the snowboard attachment, said elongate passage being orientated transverse to the longitudinal axis of the snowboard attachment and having walls configured to surround the standard snowboard; and a body part that is attached in operation to the nose part, wherein the body part has clamp through openings arranged to receive fastenings of a binding clamp of the standard snowboard, such that the clamp openings lie between the binding clamp and the standard snowboard.

According to a refinement of the first embodiment, the elongate passage passes through the nose part of the snowboard attachment.

According to another refinement of the first embodiment, the clamp through openings comprise slots aligned parallel to the longitudinal axis of the snowboard attachment.

According to a further refinement of the first embodiment, the walls of the elongate passage through the snowboard attachment include a front wall and a back wall that are each orientated transverse to the longitudinal axis of the snowboard attachment, said front and back walls being aligned substantially parallel to each other and angled upwardly with respect to the forwards direction.

According to a further refinement of the first embodiment, said openings in the top and bottom surfaces of the snowboard attachment are wedge-shaped.

In a second embodiment, the disclosure provides a snowboard attachment comprising: (a) a nose part that is operable to attach to the standard snowboard for providing the standard snowboard lift and float while riding on powder snow; (b) a body part that is attached in operation to the nose part, wherein the body part comprises a first connecting part and a second connecting part, and is placed in operation beneath the standard snowboard; (c) a first arm that comprises a first end and a second end opposite to the first end, wherein the first end of the first arm is attached in operation to the first connecting part; (d) a second arm that comprises a first end and a second end opposite to the first end, wherein the first end of the second arm is attached in operation to the second connecting part, wherein the first arm and the second arm are bent in operation around the standard snowboard to grip a top of the standard snowboard; and (e) an auxiliary attachment means selected from a strap, a rubber grip, a rubber strap, a rubber pocket, a rubber hood, an elastic strap, a rubber band, a thumbscrew, a lever, a clip, a clamp, foam or magnets, that is attached in operation to the body part, for holding the snowboard attachment in place relative to the standard snowboard.

According to a refinement of the second embodiment, the nose part comprises a first part and a second part, wherein the first part and the second part are attached in operation to each other by first attachment means, wherein the first part and the second part are adjusted in operation to fit with a nose of the standard snowboard.

According to a refinement of the first and second embodiments, the body part is attached in operation to the nose part by second attachment means to provide a setback stance to a rider of the standard snowboard when the snowboard attachment is attached in operation with the standard snowboard.

According to another refinement of the second embodiment, the nose part comprises the body part to increase surface area, width, and length of the nose of the standard snowboard.

According to yet another refinement of the second embodiment, the first arm and the second arm are attached in operation to the body part by third attachment means, wherein the first arm and the second arm are adjusted in operation to grip the top of the standard snowboard.

According to yet another refinement of the second embodiment, the second end of the first arm and the second end of the second arm are each attached in operation with an a respective attachment edge by fourth attachment means to respective edges of the standard snowboard in operation to allow the attachment edge to be in a the same plane as edges of the standard snowboard.

According to yet another refinement of the second embodiment, the second end of the first arm and the second end of the second arm comprise a notch to grip in operation the standard snowboard.

According to yet another refinement of the second embodiment, the body part comprises the first arm and the second arm to grip in operation the top of the standard snowboard.

According to yet another refinement of the second embodiment, the strap includes a plurality of flexible hook-like projections of a first component that are operable to engage onto a corresponding matting material of a second component to secure the strap, and wherein the strap is user-removable by elastically deforming the flexible hook-like projections of the first component from the matting material of the second component.

Embodiments of the present disclosure are capable of substantially eliminating, or at least partially addressing, the aforementioned problems in the prior art, and increasing surface area, length and width of a nose of the standard snowboard, and also providing a setback stance to a snowboard rider of the standard snowboard while riding on powder snow.

Additional aspects, advantages, features and objects of the present disclosure are made apparent from the drawings and the detailed description of the illustrative embodiments construed in conjunction with the appended claims that follow.

It will be appreciated that features of the present disclosure are susceptible to being combined in various combinations without departing from the scope of the present disclosure as defined by the appended claims.

BRIEF DESCRIPTION OF THE DRAWINGS

The summary above, as well as the following detailed description of illustrative embodiments, is better understood when read in conjunction with the appended drawings. For the purpose of illustrating the present disclosure, exemplary constructions of the disclosure are shown in the drawings. However, the present disclosure is not limited to specific methods and instrumentalities disclosed herein. Moreover, those in the art will understand that the drawings are not to scale. Wherever possible, like elements have been indicated by identical numbers.

Embodiments of the present disclosure will now be described, by way of example only, with reference to the following diagrams wherein.

Figure 1:
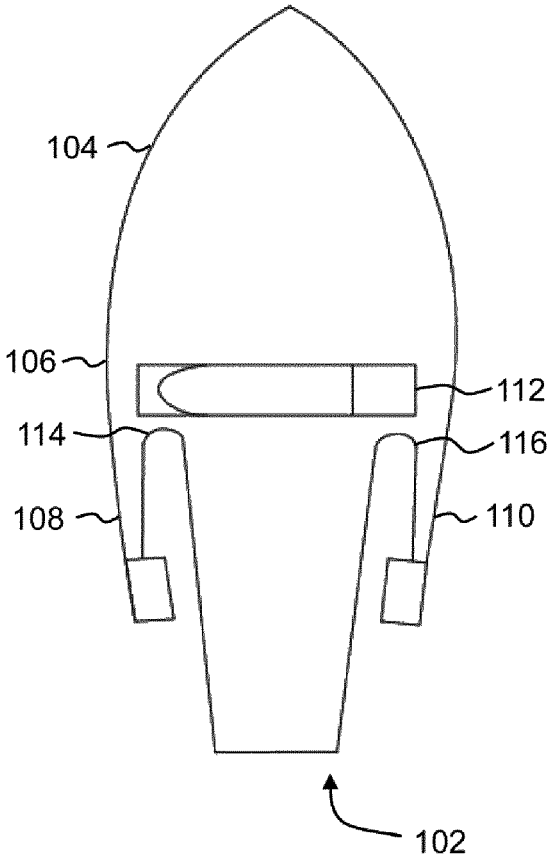
FIG. 1 is a schematic illustration of a snowboard attachment for a standard snowboard in accordance with the second embodiment of the present disclosure.

In the accompanying drawings, an underlined number is employed to represent an item over which the underlined number is positioned or an item to which the underlined number is adjacent. A non-underlined number relates to an item identified by a line linking the non-underlined number to the item.

When a number is non-underlined and accompanied by an associated arrow, the non-underlined number is used to identify a general item at which the arrow is pointing.

DETAILED DESCRIPTION OF EMBODIMENTS

The following detailed description illustrates embodiments of the present disclosure and ways in which they can be implemented. Although some modes of carrying out the present disclosure have been disclosed, those skilled in the art would recognize that other embodiments for carrying out or practicing the present disclosure are also possible.

The present disclosure provides a snowboard attachment to a standard snowboard for riding under powder snow conditions.

In a first embodiment, the snowboard attachment comprises a nose part, an elongate passage and a body part. The nose part is operable to attach to the standard snowboard for providing lift and float while riding on powder snow. The elongate passage has walls extending between an opening in a top surface of the snowboard attachment and an opening in a bottom surface of the snowboard attachment, and is orientated transverse to the longitudinal axis of the snowboard attachment. The walls of the elongate passage are configured to surround the standard snowboard. The body part is attached in operation to the nose part, and has clamp through openings. The clamp through openings are arranged to receive bolts of a binding clamp of the standard snowboard, such that the clamp through openings lie in operation between the binding clamp and the standard snowboard.

In a second embodiment, the snowboard attachment comprises a nose part, a body part, a first arm, a second arm, and an auxiliary attachment means, wherein the nose part is operable to be attached to the standard snowboard for providing the standard snowboard with lift and float while riding on powder snow, wherein the nose part comprises an oversized nose with a typical pointed shape to attach in operation to the standard snowboard, wherein the body part is operable to attach to the nose part, wherein the body part that comprises a first connecting part and a second connecting part is placed in operation beneath the standard snowboard, wherein the first arm comprises a first end and a second end opposite to the first end, wherein the first end of the first arm is attached in operation to the first connecting part, wherein the second arm comprises a first end and a second end opposite to the first end, wherein the first end of the second arm is attached in operation to the second connecting part, wherein the first arm and the second arm are bent in operation around the standard snowboard to grip a top of the standard snowboard, or the first arm and the second arm are configured to ride over edges of the top surface of the standard snowboard while the body part engages the bottom surface of the standard snowboard, and wherein the auxiliary attachment means is selected from a strap, a rubber grip, a rubber strap, a rubber pocket, a rubber hood, an elastic strap, a rubber band, a thumbscrew, a lever, a clip, a clamp, foam or magnets, which is attached in operation to the body part for holding the snowboard attachment in place relative to the standard snowboard.

In a preferred embodiment, the auxiliary attachment means is a strap.

The snowboard attachment of the disclosure improves in operation a rider's performance on powder snow. The snowboard attachment provides more surface area on a nose of the standard snowboard than a tail of the standard snowboard, to create lift or float while riding on powder snow. Further, it allows the rider to initiate the turn with the front leg it enhances the turning control. The standard snowboard may be a twin tip snowboard or a directional twin snowboard. The standard snowboard may have a symmetrical shape, or an almost symmetrical shape in case of the directional twin snowboard around a mirror line that is perpendicular to an elongate central axis of the standard snowboard, and provides a centred stance and symmetrical flex while riding.

The snowboard attachment is designed to be adjustable to fit with the standard snowboard (e.g., a twin tip snowboard, etc.) and changes effective dimensions of the standard snowboard when fitted, to improve the performance of the standard snowboard on powder snow. The snowboard attachment is designed to be adjustable to fit with the standard snowboards of varying widths without permanently altering or modifying the standard snowboard. The snowboard attachment may further increase effective surface area, width, length of a nose of the standard snowboard when fitted to the standard snowboard, to provide improved lift while riding on powder snow.

The snowboard attachment may be made up of for example metal edges, a wooden core, a plastic base, or a fiberglass, optionally bound together with an epoxy, or any suitable resins. Optionally, the snowboard attachment is an injection-molded plastics material component, or set of components. The standard snowboard may be made up of for example metal edges, a wooden core, a plastic base, or a fiberglass, optionally bound together with an epoxy, or any suitable resins.

In a refinement of the first embodiment the elongate passage passes through the nose part of the snowboard attachment.

In another refinement of the first embodiment, the walls of the elongate passage are configured to surround in operation the nose tip of the standard snowboard.

In a further refinement of the first embodiment, the clamp through openings lie in operation between the binding clamp and the base of the standard snowboard.

In a further refinement of the first embodiment, the walls of the elongate passage are configured to grip the standard snowboard in operation by its top and bottom surfaces.

In a yet further refinement of the first embodiment, the standard snowboard, in operation, passes through the elongate passage in such a way that it passes through the opening in the bottom surface and the opening in the top surface of the snowboard attachment.

In refinements of the first embodiment of the disclosure, the clamp through openings comprise through holes or through slots.

The bolt holes in standard binding clamps are typically 4 cm apart, so a pair of through slots may be provided orientated parallel to the longitudinal axis of the snowboard attachment and separated by 2 cm or 4 cm in the direction of the longitudinal axis of the snowboard attachment. Additionally, a longitudinal slot (along the longitudinal axis) may be provided for use with another type of standard snowboard attachment.

In refinements of the first embodiment of the disclosure, the elongate passage is partly occluded by one or more rubber seals selected from:

(i) a rubber bush extending from a front wall of the passage;

(ii) a rubber flap extending from a back wall of the passage;

(iii) a rubber tube running substantially parallel to and extending from the back wall of the passage; and (iv) rubber lips extending from side walls of the passage.

The rubber may be neoprene, and may have a Shore A hardness less than 80. By using such rubber seals the intrusion of snow through the elongate passage in operation may be substantially reduced. The rubber bush also helps to provide improved stability with respect to relative movement of the nose tip of the standard snowboard relative to the nose part of the snowboard attachment.

In a refinement of the second embodiment, the first end of the first arm is attached to the first connecting part using, for example, an adhesive material (e.g., glue), a clip, a rivet, a hinge, a nail, a teeth assembly, magnets, a screw, or a strap.

In a refinement of the second embodiment, the first end of the second arm is attached to the second connecting part using, for example, an adhesive material (e.g., glue), a clip, a rivet, a hinge, a nail, a teeth assembly, magnets, a screw, or a strap.

In a refinement of the embodiments, a length of the snowboard attachment is in a range of ca 600 mm to ca 900 mm, a width of snowboard attachment is in a range of ca 250 mm to ca 450 mm, and a thickness of the snowboard attachment is in a range of ca 3 mm to ca 15 mm, and more preferably 4 to 10 mm. In another embodiment, the length of the snowboard attachment is substantially 750 mm (e.g. +/−20% and more preferably +/−10%), the width of snowboard attachment is substantially 350 mm (e.g. +/−30% and more preferably +/−10%), and the thickness of the snowboard attachment is substantially 6 mm (e.g. +/−40% and more preferably +/−10%). In yet another embodiment, a nose length of the snowboard attachment is in a range of 246.5 mm to 417 mm, a nose width of the snowboard attachment is in a range of 46 mm to 79 mm, and a nose height of the snowboard attachment is in a range of 25 mm to 125 mm, and more preferably 50 mm to 100 mm. In a further embodiment the snowboard attachment has a thickness from ca 3.5 mm at the nose region, ca 9.75 mm at the elongated passage region, and ca 4.5 mm at the clamp binding region. The snowboard attachment has a total length of ca 865 mm, a nose length of ca 365 mm and a nose height of ca 85 mm. The snowboard attachment is preferrably ca 350 mm in width.

For snowboards in accordance with the first embodiment, it is preferred to provide sides of the snowboard attachment adjacent ends of the elongate passage which are thicker than other regions of the snowboard attachment. The thickness at the nose is ca 3.5 mm (e.g. +/−30%), then increasing in thickness to be ca 9.75 mm (e.g. +/−30%) by the elongated passage of the snowboard attachment, and then decreases in thickness to ca 4.5 mm (e.g. +/−30%) underneath the binding clamp. These regions may in addition or alternatively be reinforced with carbon fibre. These regions may be thicker than the remainder of the snowboard attachment. Increased thickness or carbon fibre reinforcement strengthen the sides of the snowboard attachment by a factor of three with very little weight increase, to prevent premature damage in use.

The body part of the snowboard attachment may be made thicker than the nose part. With the normal thickness of body part, snow can build up in use between the body part and the standard snowboard. By providing a slightly thicker body part, the flexibility of the body part is reduced to the extent that it significantly reduces snow intrusion.

The snowboard attachment with a wooden core may comprise a relatively soft wood e.g. poplar, or a stiff wood e.g. beech. Preferably, the softer wood may be incorporated into the nose part, while a stiff wood may be used for the edges of the standard snowboard, particularly sides of the snowboard attachment adjacent ends of the elongate passage. A suitable wood to improve the strength is beech.

According to a refinement of the second embodiment, the nose part comprises a first part and a second part. The first part and the second part are attached in operation to each other by a first attachment arrangement. The first part and the second part are adjusted in operation to fit within a nose of the standard snowboard.

The first part and the second part of the nose part are adjustable, such that, the nose part may be fitted in operation to standard snowboards of varying widths without permanently altering or modifying the standard snowboards.

The first attachment arrangement can be any suitable means, such as hinges, clips, screws, rivets, nails, belts, straps, or adhesive materials (e.g., glue). In an embodiment, the first part and the second part are attached in operation to each other using a teeth assembly. In another embodiment, the first part and the second part are attached to each other in operation using a binding clamp. In yet another embodiment, the first part and the second part are attached to each other in operation using magnets, for example using powerful rare-earth element magnets. In yet another embodiment, the first part and the second part are attached to each other in operation using a sliding lock assembly. The first part, and/or the second part of the nose part may be made up of, for example, metal edges, a wooden core, a plastic base, or a fiberglass, optionally bound together with an epoxy, or any suitable resins.

According to another refinement of the embodiments, the body part is attached in operation to the nose part by a second attachment arrangement to provide a setback stance to a rider of the standard snowboard when the snowboard attachment is attached in operation to the standard snowboard.

The nose part that is attached with the body part provides an increased surface area to a rider while riding on powder snow. The nose part, and/or the body part may be made up of, for example, metal edges, a wooden core, a plastic base, or a fiberglass, optionally bound together with an epoxy, or any suitable resins.

The second attachment arrangement can be any suitable attachment device, such as hinges, clips, screws, rivets, nails, belts, straps, a binding clamp, or adhesive materials (e.g., glue). In an embodiment, the body part is attached in operation to the nose part using a teeth assembly. In another embodiment, the body part is attached in operation to the nose part using magnets, for example by using powerful rare-earth magnets.

According to another refinement of the embodiments, the nose part comprises the body part to increase surface area, width, and length of the nose of the standard snowboard.

The first and second attachment arrangements are operable to prevent detachment of the body part from the nose part while riding. The increased surface area, width, and length of the nose of the standard snowboard achieved by attaching embodiments of the present disclosure may provide an increased setback stance for a rider of the standard snowboard while riding on powder snow.

According to another refinement of the second embodiment, the first arm and the second arm are attached in operation to the body part by a third attachment arrangement. The first arm and the second arm are adjusted in operation to grip the top of the standard snowboard.

The first arm and the second arm are bent in operation around the standard snowboard and are adjusted to grip the standard snowboard tightly to the snowboard attachment.

The third attachment arrangement can be any suitable attachment device, such as hinges, clips, screws, rivets, nails, belts, straps, a binding clamp, or adhesive materials (e.g., glue). In an embodiment, the first arm and the second arm are attached in operation to the body part using a teeth assembly. In another embodiment, the first arm and the second arm are attached in operation to the body part using magnets, for example by using powerful rare-earth magnets.

In an embodiment, the first arm and the second arm are attached in operation to the body part through the first connecting part and the second connecting part respectively. The first arm, the second arm, the first connecting part and/or the second connecting part may be made up of, for example, metal edges, a wooden core, a plastic base, or a fiberglass, optionally bound together with an epoxy, or any suitable resins.

According to another refinement of the second embodiment, the second end of the first arm and the second end of the second arm are attached in operation to an attachment edge by a fourth attachment arrangement to allow the attachment edge to be in a same plane with edges of the standard snowboard.

The attachment edge of the first arm and the second arm creates a space to accommodate edges of the standard snowboard, thereby improving performance of the standard snowboard while riding on powder snow. The attachment edge of the first arm and the second arm may be made up of, for example, metal edges, a wooden core, a plastic base, or a fiberglass, optionally bound together with an epoxy, or any suitable resins.

The fourth attachment arrangement can be any suitable attaching device, such as hinges, clips, screws, rivets, nails, belts, straps, a binding clamp, or adhesive materials (e.g., glue). In an embodiment, the second end of the first arm and the second end of the second arm are attached in operation by employing an attachment edge using magnets, for example by using powerful rare-earth magnets.

According to another refinement of the second embodiment, the second end of the first arm and the second end of the second arm comprise a notch to grip the standard snowboard with less arm movement. The notch in the first arm and the second arm provides in operation a space that allows edges of the standard snowboard to be in a same plane with the snowboard attachment, thereby improving the performance of the standard snowboard while riding on powder snow. In an embodiment, instead of using notches, a separate wood piece is glued onto the second end of the first arm and the second end of the second arm to create in operation a space for accommodating the edges of the standard snowboard.

According to another refinement of the second embodiment, the body part comprises the first arm and the second arm that are operable to grip the top of the standard snowboard. The first arm and the second arm may be bent around the standard snowboard and adjusted upwards/outwards to fit in operation with different sizes of the standard snowboards. The first arm and the second arm may be adjusted upwards/outwards to attach/detach the standard snowboard from the snowboard attachment.

According to another refinement of the second embodiment, the strap is implemented as a Velcro® strap; "Velcro" is a registered trademark and relates to an attachment device, wherein a plurality of plastics-material hook-like projections of a first component are operable to ensnarl with plastics-material matted threads of a second component, and wherein the first and second components are capable of being reversibly pulled apart by elastically deforming the plastics-material hook-like projections so that they disengage from the plastics-material matted threads of the second component. The strap holds the snowboard attachment in place relative to the standard snowboard. The strap may be used to grip the standard snowboard with the snowboard attachment while riding on powder snow. The strap may prevent detachment of the standard snowboard from the snowboard attachment.

In embodiments of the second embodiment of the disclosure, an auxiliary attachment means is provided, which is selected from a strap, a rubber grip, a rubber strap, a rubber pocket, a rubber hood, an elastic strap, a rubber band, a thumbscrew, a lever, a clip, a clamp, foam or magnets. This is used to hold the snowboard attachment in place when in operation relative to the standard snowboard.

Embodiments of the present disclosure may be used to attach with the standard snowboards of varying widths (e.g., a twin tip snowboard, etc.) to improve the performance of the standard snowboard on powder snow. For example, the embodiments may be used to attach with the standard snowboard to provide the standard snowboard with improved lift and float while riding on powder snow. The embodiments may be used to attach with the standard snowboard without permanently altering or modifying the standard snowboard.

DETAILED DESCRIPTION OF THE DRAWINGS

FIG. 1 is a schematic illustration of a snowboard attachment 102 for a standard snowboard in accordance with the second embodiment of the present disclosure. The snowboard attachment 102 comprises a nose part 104, a body part 106, a first arm 108, a second arm 110, and a strap 112. The nose part 104 is operable to attach to the standard snowboard for providing an improved lift and float while riding on powder snow. The nose part 104 may comprise an oversized nose with a pointed shape to create an improved lift and float while riding on powder snow. The body part 106 is attached in operation to the nose part 104. The body part 106 comprises a first connecting part 114, and a second connecting part 116. The body part 106 is placed in operation beneath the standard snowboard. The first arm 108 comprises a first end and a second end opposite to the first end. The first end of the first arm 108 is attached in operation to the first connecting part 114. The second arm 110 comprises a first end and a second end opposite to the first end. The first end of the second arm 110 is attached in operation to the second connecting part 116. The first arm 108 and the second arm 110 are bent in operation around the standard snowboard to grip a top of the standard snowboard. The second end of the first arm 108 and the second end of the second arm 110 are attached in operation with an attachment edge to allow the attachment edge to be in a same plane with edges of the standard snowboard. The strap 112 is attached in operation to the body part 106 for holding the snowboard attachment 102 in place relative to the standard snowboard.

Figure 2:
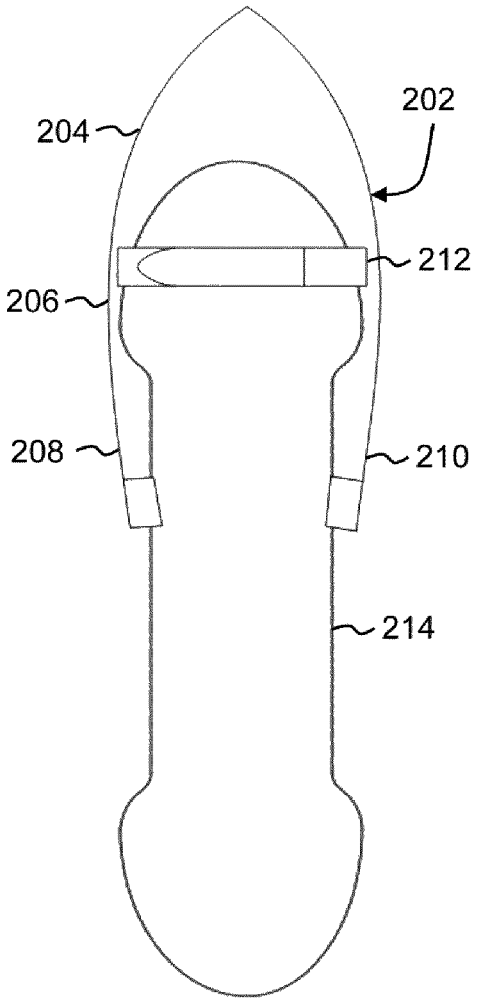
Referring to FIG. 2, there is provided a schematic illustration of a snowboard attachment that is attached in operation to a standard snowboard in accordance with the second embodiment of the present disclosure.

Referring next to FIG. 2, there is provided a schematic illustration of a snowboard attachment 202 that is attached in operation to a standard snowboard 214 in accordance with the second embodiment of the present disclosure. The snowboard attachment 202 comprises a nose part 204, a body part 206, a first arm 208, and a second arm 210 and a strap 212. These parts function as has been described above.

Figure 3:
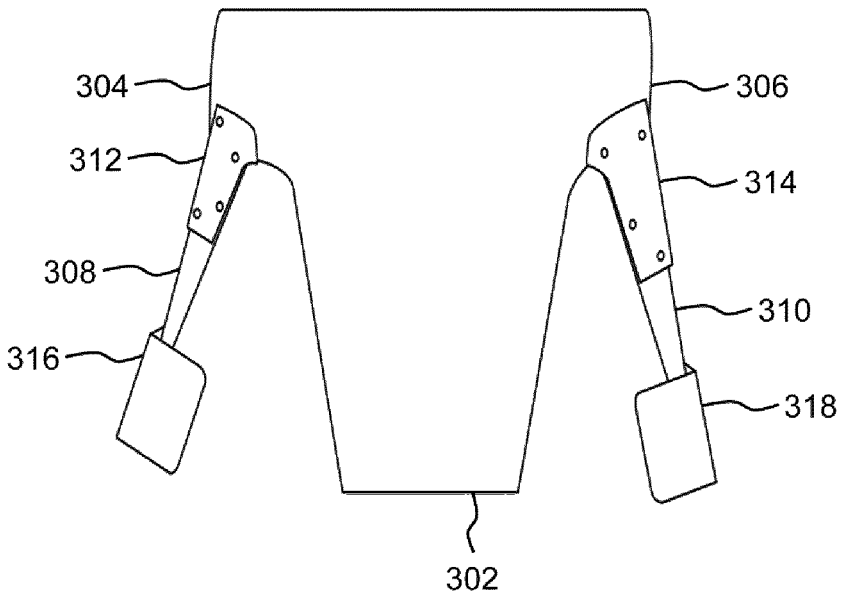
Referring to FIG. 3, there is provided a schematic illustration of a body part of a snowboard attachment, in accordance with the second embodiment of the present disclosure.

Referring next to FIG. 3, there is provided a schematic illustration of a body part 302 of a snowboard attachment in accordance with the second embodiment of the present disclosure. The body part 302 comprises a first connecting part 304, a second connecting part 306, a first arm 308, and a second arm 310. The first arm 308 comprises a first end, and a second end opposite to the first end. The first end of the first arm 308 is attached in operation to the first connecting part 304 using a first hinge assembly 312. The second end of the first arm 308 comprises a first attachment edge 316. The second arm 310 comprises a first end, and a second end opposite to the first end. The first end of the second arm 310 is attached in operation to the second connecting part 306 using a second hinge assembly 314. The second end of the second arm 310 comprises a second attachment edge 318. The first attachment edge 316 and the second attachment edge 318 are in a same plane with edges of the standard snowboard.

Figure 4:
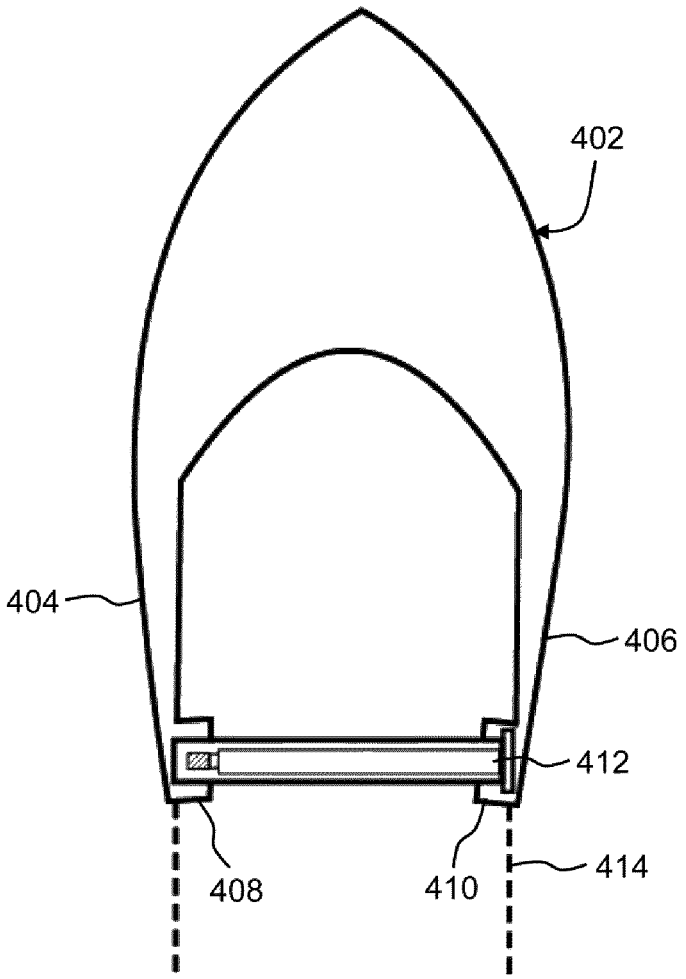
Referring to FIG. 4, there is provided a schematic illustration of a snowboard attachment that comprises a first attachment edge and a second attachment edge, in accordance with the second embodiment of the present disclosure.

Referring next to FIG. 4, there is provided a schematic illustration of a snowboard attachment 402 that comprises a first attachment edge 408 and a second attachment edge 410 in accordance with the second embodiment of the present disclosure. The snowboard attachment 402 comprises a first arm 404, a second arm 406, the first attachment edge 408, the second attachment edge 410, and a strap 412. The first arm 404 comprises the first attachment edge 408. In an embodiment, the first arm 404 is attached in operation with the first attachment edge 408. The second arm 406 comprises the second attachment edge 410. In an embodiment, the second arm 406 is attached in operation with the second attachment edge 410. The first attachment edge 408 and the second attachment edge 410 are attached in operation with the strap 412 to hold the first arm 404 and the second arm 406 tightly with a standard snowboard 414 to provide a rigid edge attachment.

Figure 5:
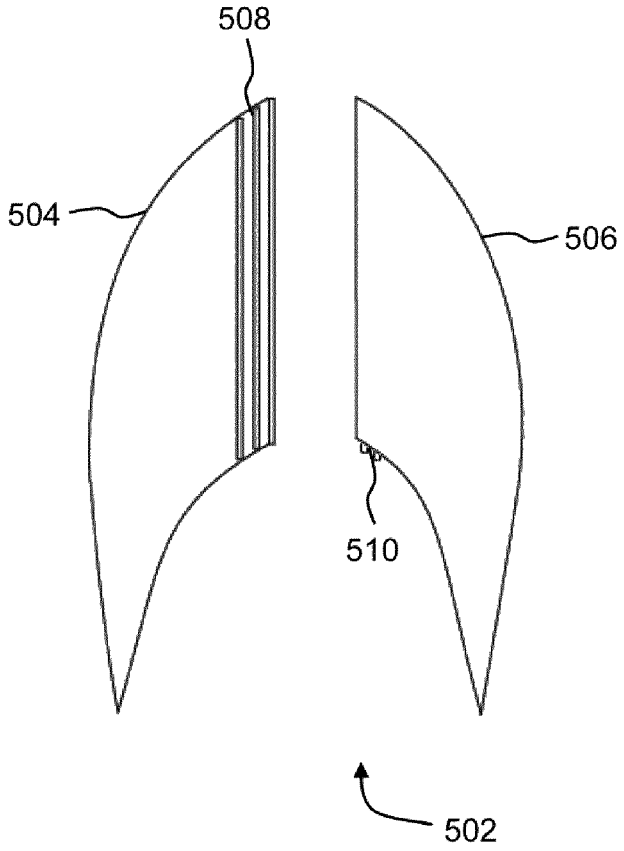
Referring to FIG. 5, there is provided a schematic illustration of a first part and a second part of a snowboard attachment that are attached in operation to each other using sliding lock mechanism, in accordance with the second embodiment of the present disclosure.

Referring next to FIG. 5, there is provided a schematic illustration of a first part 504 and a second part 506 of a snowboard attachment 502 that are attached in operation to each other using sliding lock mechanism in accordance with the second embodiment of the present disclosure. The first part 504 comprises sliding arms 508. The second part 506 comprises sliding ports 510. The first part 504 and the second part 506 may be attached in operation to each other by locking the sliding arms 508 of the first part 504 with the sliding ports 510 of the second part 506. The first part 504 and the second part 506 may be adjusted in operation with respect to a width of a nose of a standard snowboard by locking the sliding arms 508 of the first part 504 with different sliding ports 510 of the second part 506. The sliding ports 510, which are empty after attaching/locking the first part 504 with the second part 506, are filled with fillers (e.g. wooden filler, synthetic filler, etc.). The snowboard attachment 502 may comprise a rubber strap that wraps in operation around the standard snowboard to grip the snowboard attachment 502 with the standard snowboard. In an embodiment, the first part 504 and the second part 506 may be made up of wood.

Figure 6:
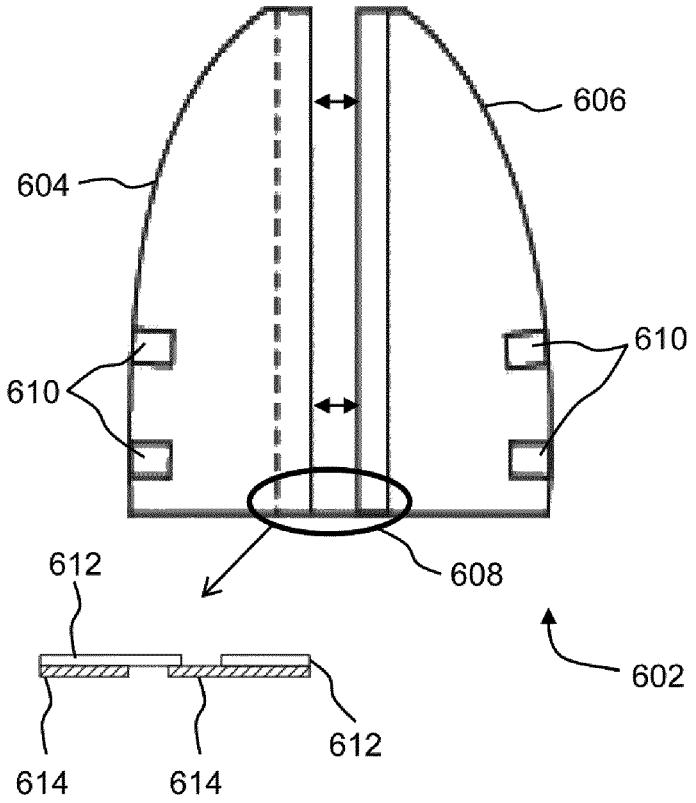
Referring to FIG. 6, there is provided a schematic illustration of a first part and a second part of a snowboard attachment that are attached in operation to each other using an interlocking base, in accordance with the second embodiment of the present disclosure.

Referring next to FIG. 6, there is provided a schematic illustration of a first part 604 and a second part 606 of a snowboard attachment 602 that are attached in operation to each other using an interlocking base 608 in accordance with the second embodiment of the present disclosure. The first part 604 and the second part 606 comprise the interlocking base 608. The interlocking base 608 comprises a top sheet 612 and a base sheet 614. The top sheet 612 and the base sheet 614 are adjusted in operation to modify a width of the snowboard attachment 602 to fit with various widths of standard snowboards. The first part 604 and the second part 606 comprise attachment arms 610 that clamp in operation over a standard snowboard for holding the snowboard attachment 602 with the standard snowboard. The attachment arms 610 may be clamped in operation with the standard snowboard using a thumbscrew, or a lever. The attachment arms 610 may comprise an elastic strap to hold in operation the snowboard attachment 602 tightly with the standard snowboard.

Figure 7:
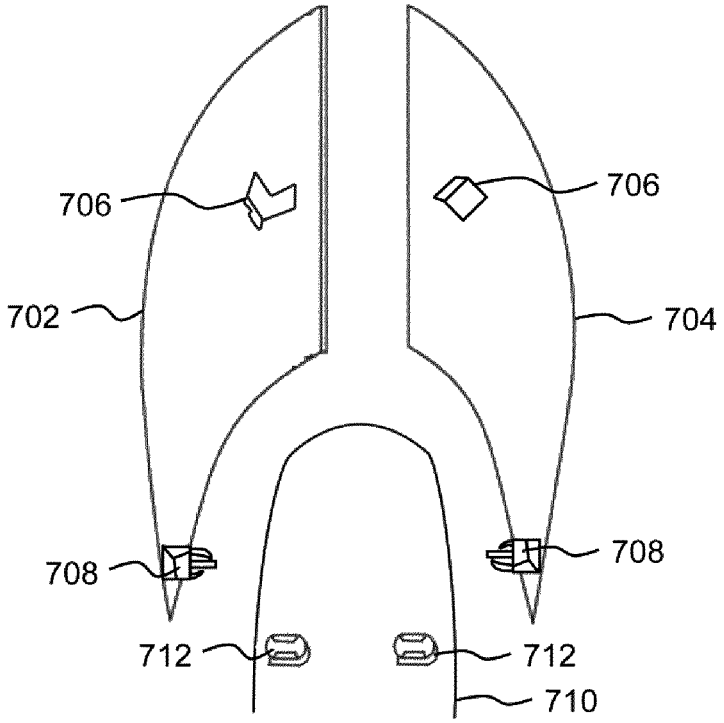
Referring to FIG. 7, there is provided a schematic illustration of a first part and a second part of a snowboard attachment that are attached to each other in operation by using a first clip, in accordance with the second embodiment of the present disclosure.

Referring next to FIG. 7, there is provided a schematic illustration of a first part 702 and a second part 704 of a snowboard attachment that are attached to each other in operation by using a first clip 706 in accordance with the second embodiment of the present disclosure. The first part 702 and the second part 704 comprise the first clip 706 that attaches in operation the first part 702 with the second part 704 to form the snowboard attachment. The first clip 706 may be, for example, a split-board clip. The first part 702 and the second part 704 comprise second clips 708. The second clips 708 are attached in operation to slots 712 of a standard snowboard 710 for holding the snowboard attachment in place relative to the standard snowboard 710.

Figure 8A:
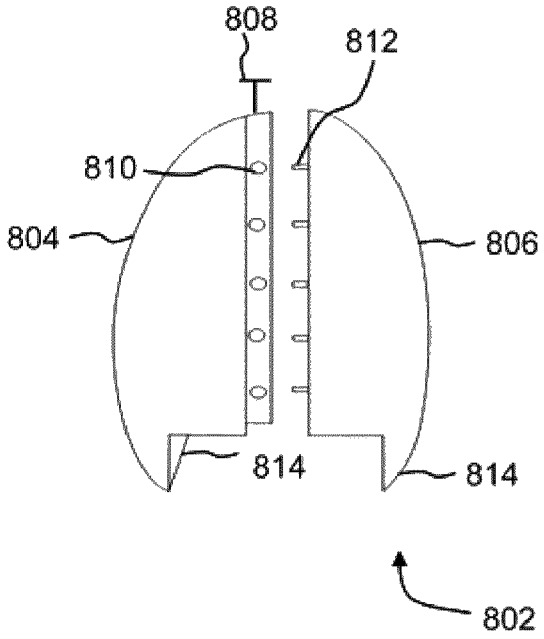
Referring to FIGS. 8A and 8B, there are provided schematic illustrations of a first part and a second part of a snowboard attachment that are attached to each other in operation by using a screw, in accordance with the second embodiment of the present disclosure.
Figure 8B:
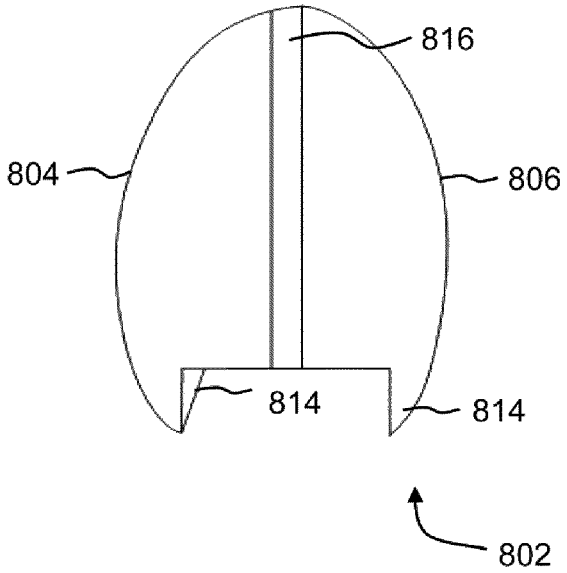

Referring next to FIGS. 8A and 8B, there are provided schematic illustrations of a first part 804 and a second part 806 of a snowboard attachment 802 that are attached to each other in operation by using a screw 808 in accordance with the second embodiment of the present disclosure. The first part 804 comprises first slots 810. The second part 806 comprises second slots 812. The first slots 810 are operable to receive the second slots 812 when the second part 806 is attached with the first part 804. The second part 806 is attached in operation with the first part 804 in such a way that the first slots 810 and the second slots 812 are in same line. The screw 808 is inserted in operation through the first slots 810 and the second slots 812 to tighten/attach the first part 804 with the second part 806. The snowboard attachment 802 may comprise a removable part 816 that is placed to fill empty space at a joining portion of the first part 804 and the second part 806. The first part 804 and the second part 806 may comprise a rubber 814 to grip a standard snowboard.

Figure 9A:
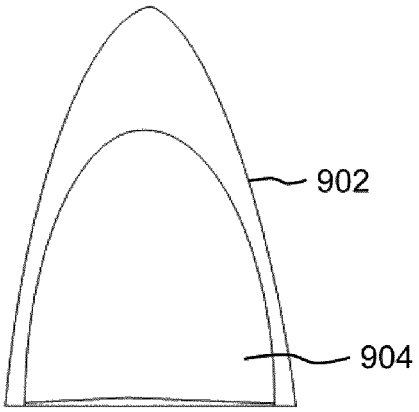
Referring to FIGS. 9A and 9B, there are provided schematic illustrations of part of a snowboard attachment, in accordance with an embodiment of the present disclosure that comprises a pocket.
Figure 9B:
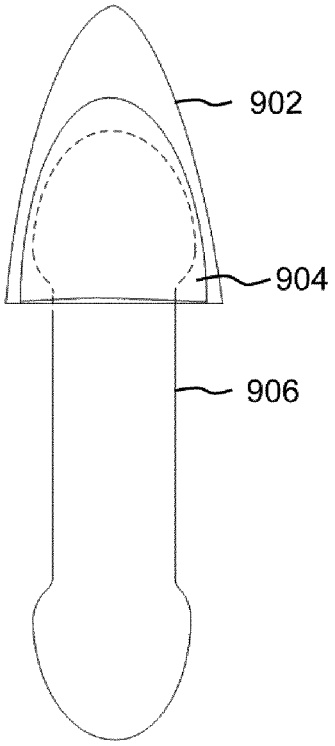

Referring next to FIGS. 9A and 9B, there are provided schematic illustrations of part of a snowboard attachment 902 that comprises a pocket 904 in accordance with an embodiment of the present disclosure. The snowboard attachment 902 comprises the pocket 904 on a base side to grip tightly in operation a standard snowboard 906 with the snowboard attachment 902 when the standard snowboard 906 is inserted into the pocket 904. The pocket 904 may be, for example, a rubber pocket.

Figure 10A:
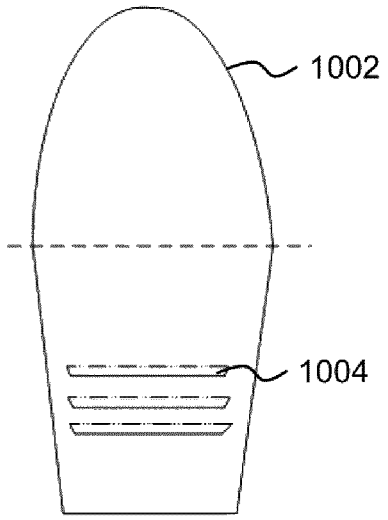
Referring to FIGS. 10A and 10B, there are provided schematic illustrations of part of a snowboard attachment, in accordance with an embodiment of the present disclosure that comprises rubber strips.
Figure 10B:
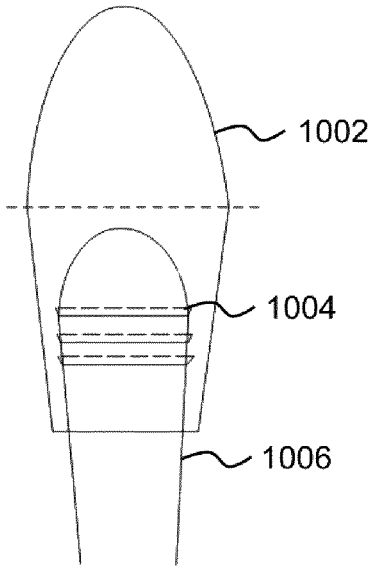

Referring next to FIGS. 10A and 10B, there are provided schematic illustrations of part of a snowboard attachment in accordance with an embodiment of the present disclosure 1002 that comprises rubber strips 1004. The snowboard attachment 1002 comprises the rubber strips 1004 on both sides (i.e. a top side and a base side of the snowboard attachment 1002). The rubber grips 1004 on a top of the snowboard attachment 1002 grips a base of a standard snowboard 1006. The rubber grips 1004 on a base of the snowboard attachment 1002 grips a top of the standard snowboard 1006. The snowboard attachment 1002 may comprise a Velcro® or an elastic strap to hold the snowboard attachment 1002 tightly in operation with the standard snowboard 1006.

Figure 11A:
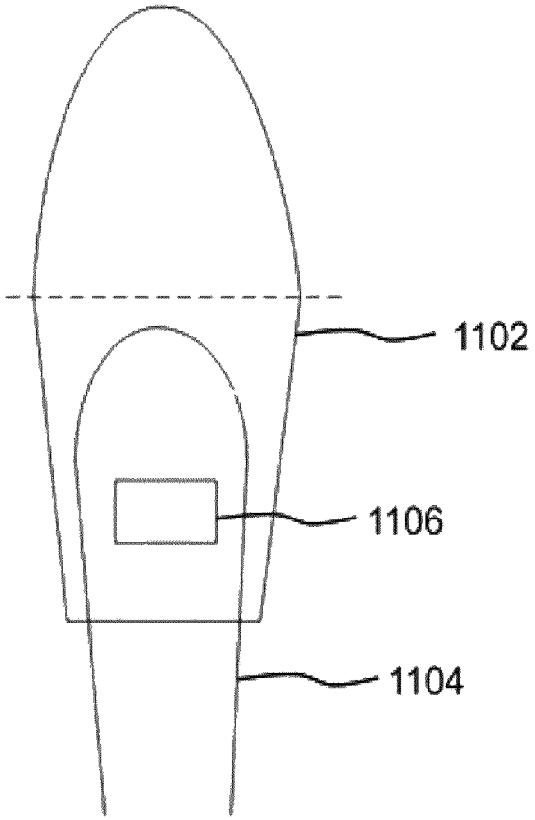
Referring to FIGS. 11A and 11B, there are provided schematic illustrations of part of a snowboard attachment and part of a standard snowboard, in accordance with the second embodiment of the present disclosure that are attached together in operation by using magnets.
Figure 11B:
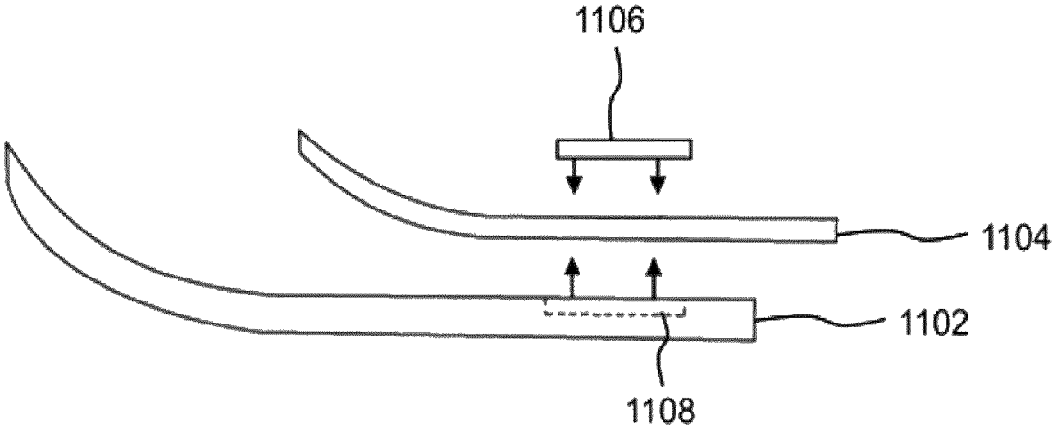

Referring next to FIGS. 11A and 11B, there are provided schematic illustrations of part of a snowboard attachment 1102 in accordance with the second embodiment of the present disclosure and part of a standard snowboard 1104 that are attached together in operation by using magnets. The snowboard attachment 1102 that is embedded with a first magnet 1108 is placed beneath a base of the standard snowboard 1104. A second magnet 1106 (e.g., a detachable magnet, etc.) may be placed over a top of the standard snowboard 1104. The standard snowboard 1104 may be embedded with the second magnet 1106, preferably at a nose of the standard snowboard 1104. The magnetic force between the first magnet 1108 and the second magnet 1106 grips the snowboard attachment 1102 with the standard snowboard 1104.

Figure 12:
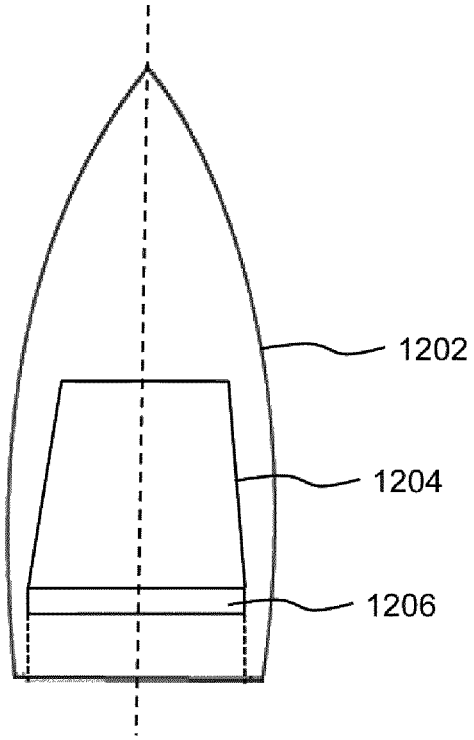
Referring to FIG. 12, there is provided a schematic illustration of part of a snowboard attachment, in accordance with the first embodiment of the present disclosure.

Referring next to FIG. 12, there is provided a schematic illustration of a part of a snowboard attachment 1202 in accordance with the first embodiment of the present disclosure. The snowboard attachment 1202 comprises a cut-out section 1204, and a slot 1206. The cut-out section 1204 may accommodate in operation a standard snowboard of varying thickness. The slot 1206 provides an opening for inserting the standard snowboard.

Figure 13:
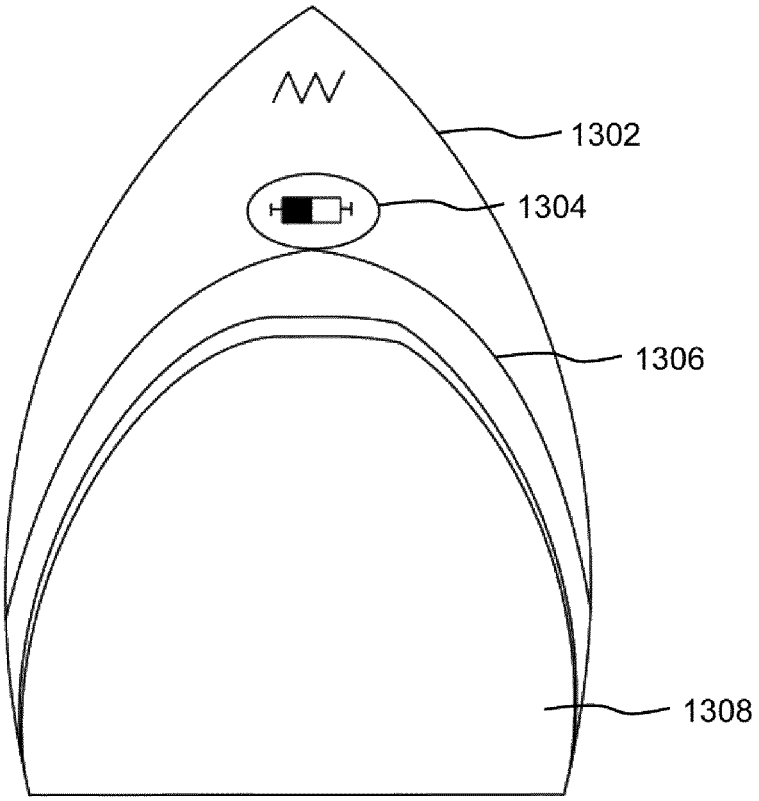
Referring to FIG. 13, there is provided a schematic illustration of part of a snowboard attachment that comprises a wind-up assembly, in accordance with the second embodiment of the present disclosure.

Referring next to FIG. 13, there is provided a schematic illustration of a part of a snowboard attachment 1302 that comprises a wind-up assembly 1304 in accordance with the second embodiment of the present disclosure. The wind-up assembly 1304 comprises a teeth portion to lock in operation the snowboard attachment 1302 with a standard snowboard 1308. The wind-up assembly 1304 comprises a wire 1306 (e.g., steel wire) that is operable to bring edges under tension around the standard snowboard 1308.

Figure 14:
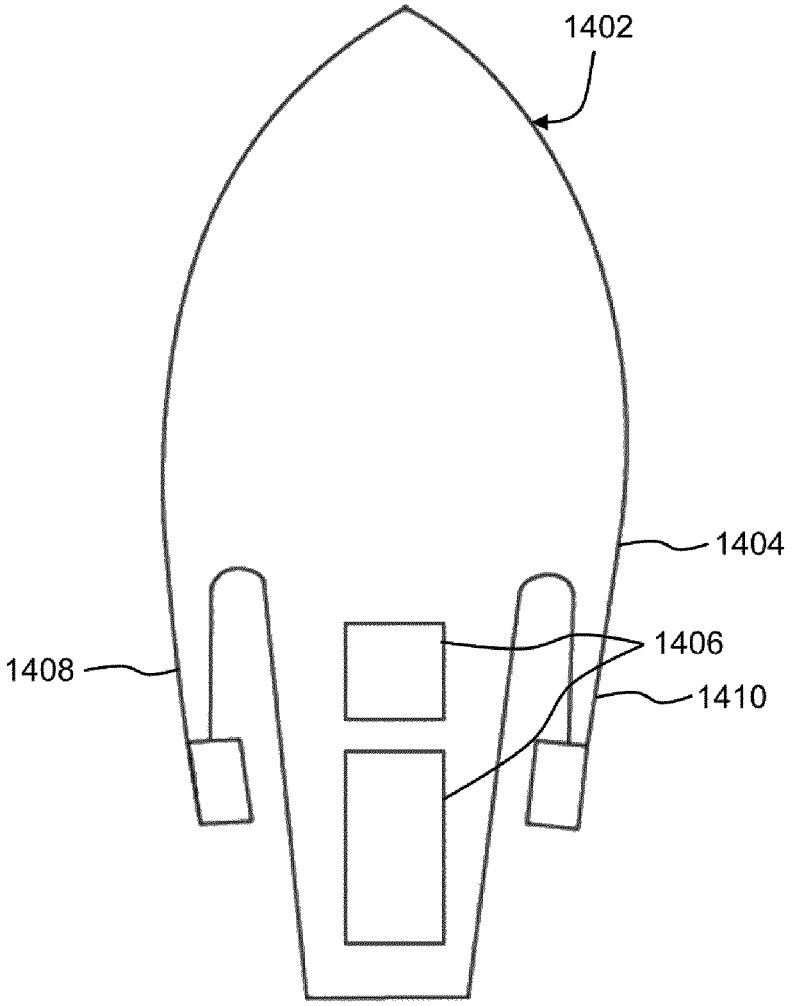
Referring to FIG. 14, there is provided a schematic illustration of a snowboard attachment that comprises rubber strips on a body part, in accordance with the second embodiment of the present disclosure.

Referring next to FIG. 14, there is provided a schematic illustration of a snowboard attachment 1402 that comprises rubber strips 1406 on a body part 1404 in accordance with the second embodiment of the present disclosure. The snowboard attachment 1402 comprises the body part 1404, the rubber grips 1406, a first arm 1408 and a second arm 1410. The rubber strips 1406 are operable to hold a base and a top of a standard snowboard. The first arm 1408 and the second arm 1410 are wrapped in operation around the standard snowboard to grip the top of the standard snowboard.

Figure 15:
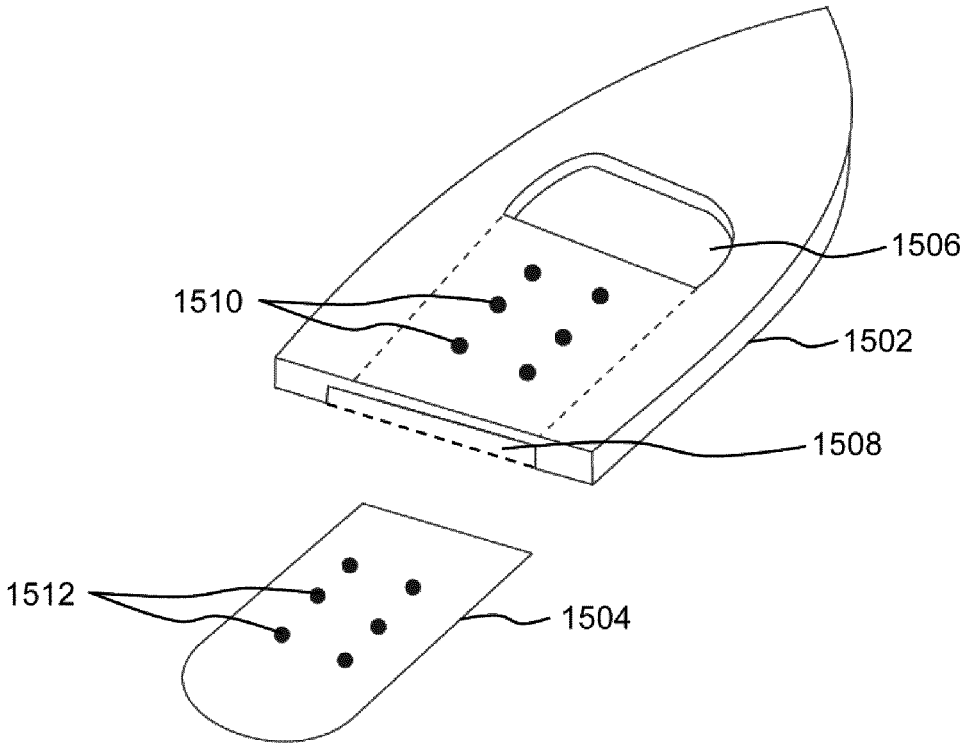
Referring to FIGS. 15 and 16, there are provided schematic illustrations of a snowboard attachment that is attached in operation to a standard snowboard by using a binding clamp in accordance with the first embodiment of the present disclosure.
Figure 16:
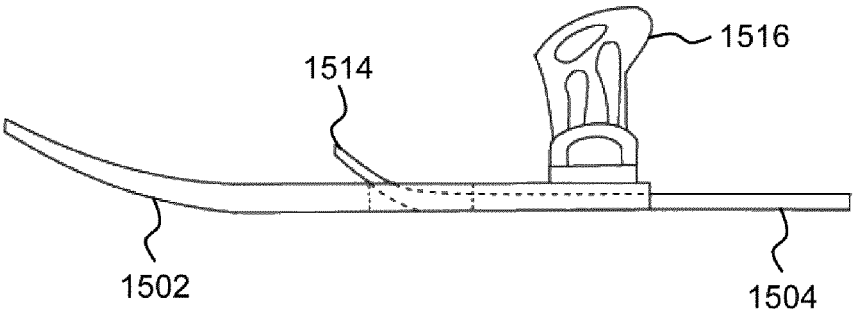

Referring next to FIGS. 15 and 16, there are provided schematic illustrations of a snowboard attachment 1502 that is attached in operation to a standard snowboard 1504 by using a binding clamp 1516 in accordance with the first embodiment of the present disclosure. The snowboard attachment 1502 comprises an opening 1506, a cut-out channel 1508, and first slots 1510. The standard snowboard 1504 comprises second slots 1512.

The standard snowboard 1504 is attached in operation with the snowboard attachment 1502 by inserting the standard snowboard 1504 through the cut-out channel 1508. The standard snowboard 1504 is inserted into the snowboard attachment 1502 until a nose 1514 of the standard snowboard 1504 is projected out through the opening 1506 of the snowboard attachment 1502, and until the first slots 1510 and the second slots 1512 are in same line. The snowboard attachment 1502 is attached in operation with the standard snowboard 1504 by using the binding clamp 1516. The snowboard attachment 1502 are then screwed into the standard snowboard 1504 by inserting binding screws of the binding clamp 1516 through the first slots 1510 and the second slots 1512. The snowboard attachment 1502 may be clamped beneath the binding clamp 1516 to provide improved stability to the snowboard attachment.

Figure 17:
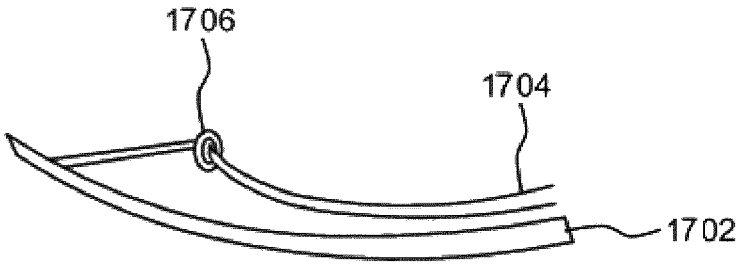
Referring to FIG. 17, there is provided a schematic illustration of part of a snowboard attachment that is attached in operation to a standard snowboard by using a clamp, in accordance with an embodiment of the present disclosure.

Referring next to FIG. 17, there is provided a schematic illustration of a part of a snowboard attachment 1702 that is attached in operation to a standard snowboard 1704 by using a clamp 1706 in accordance with an embodiment of the present disclosure. The clamp 1706 may be tightened on a nose of the standard snowboard 1704. The clamp 1706 may comprise an elastic connection, or a rope to grip the snowboard attachment 1702 tightly in operation with the standard snowboard 1704. The clamp 1706 may be a part of the snowboard attachment 1702, or the standard snowboard 1704.

Figure 18:
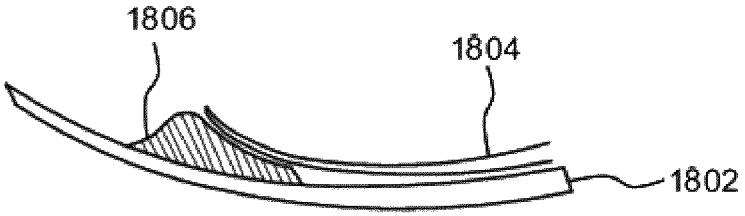
Referring to FIG. 18, there is provided a schematic illustration of part of a snowboard attachment that comprises foam, in accordance with an embodiment of the present disclosure.

Referring next to FIG. 18, there is provided a schematic illustration of a part of a snowboard attachment 1802 that comprises foam 1806 in accordance with an embodiment of the present disclosure. The foam 1806 is operable to hold a base of a standard snowboard 1804. The foam 1806 may be a dual density foam. The foam 1806 may be encapsulated by using a waterproof cover. The amount of the foam 1806 at the base of the standard snowboard 1804 may be high to prevent any larger impact while riding on powder snow. The amount of the foam 1806 along the remaining part of standard snowboard 1804 may be low to provide dampening cushion to the standard snowboard 1804.

Figure 19:
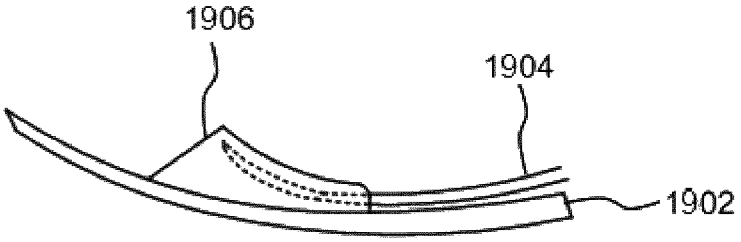
Referring to FIG. 19, there is provided a schematic illustration of part of a snowboard attachment that comprises a rubber hood, in accordance with an embodiment of the present disclosure.

Referring next to FIG. 19, there is provided a schematic illustration of a part of a snowboard attachment 1902 that comprises a rubber hood 1906 in accordance with an embodiment of the present disclosure. The snowboard attachment 1902 comprises the rubber hood 1906 on a base side. The rubber hood 1906 may grip a standard snowboard 1904 tightly in operation with the snowboard attachment 1902 when a nose of the standard snowboard 1904 is encapsulated into the rubber hood 1906. The rubber hood 1906 may prevent entering of snow into a gap between the snowboard attachment 1902 and the standard snowboard 1904.

Figure 20:
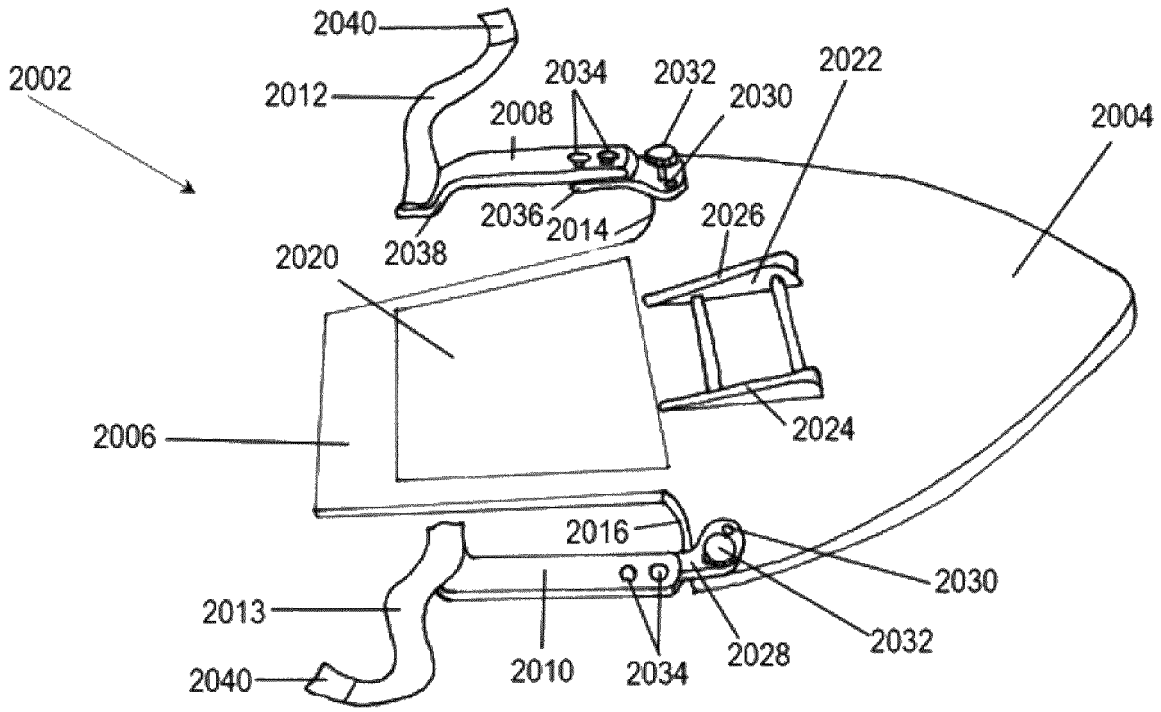
Referring to FIG. 20, there is provided a view from above the right-hand side of an example of a snowboard attachment, in accordance with the second embodiment of the present disclosure.

FIG. 20 shows a view from above the right-hand side of an example of a snowboard attachment 2002. It is designed to assemble with a standard snowboard. The body part 2006 is trapezium shaped and has a trapezium shaped rubber sheet 2020 attached to its top surface, enabling improved grip with the standard snowboard. The body part 2006 is continuous with a mitre-shaped nose part 2004. The nose part 2004 has a ramp 2022 constructed of rigid material, which is shaped to support the base surface of a standard snowboard. The ramp has right-hand 2024 and left-hand 2026 channels which may have rubber strips inserted for improved grip with the standard snowboard. The nose part 2004 has first and second attachment edges 2014, 2016, each having a hinge assembly 2028. The hinge assembly is hinged about hinge bolt 2030, and clamped into place using knurled thumbscrew 2032. The first 2014 and second 2016 attachment edges have respective first 2008 and second 2010 arms. Each arm is attached rigidly to a tail 2036 of the hinge assembly using 2 bolts 2034, so that each arm is in a plane above that of the tails 2036 of the hinge assembly, which in turn is above the plane of the top surface of the attachment edge. Thus, each arm is configured to be in a plane that allows it to ride over the top surface of the standard snowboard. Each arm has an inward turned clamping end 2038, to which is attached a strap 2012, 2013. The straps 2012, 2013 from each arm may be pulled together and tightened around the standard snowboard using a buckle or hook-and-loop material 2040.

Figure 21C:
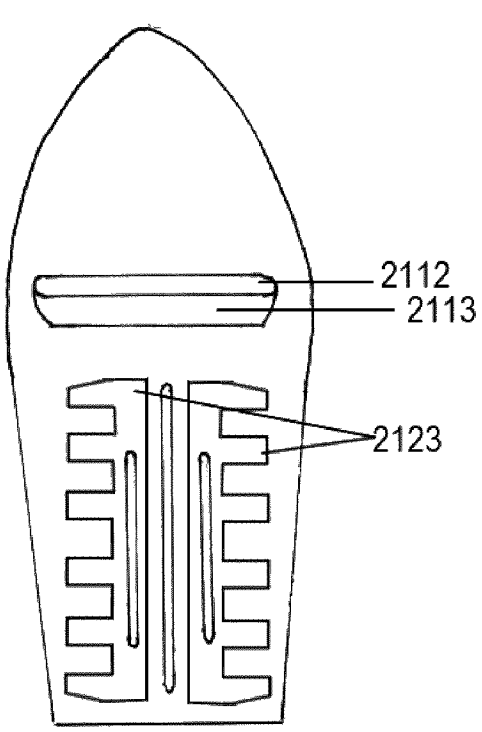
Referring to FIG. 21C, there is provided a view from below of a snowboard attachment, in accordance with the first embodiment of the present disclosure, similar to the example of FIG. 21A-B but with rubber pads.
Figure 21B:
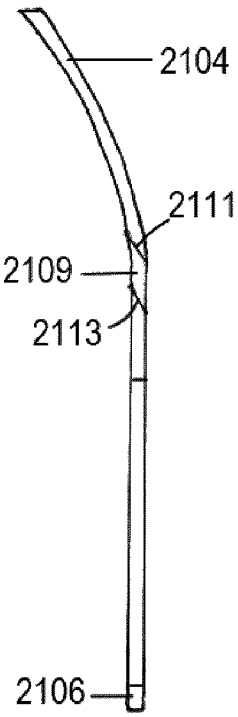
Referring to FIG. 21B, there is provided a vertical cross section through the longitudinal axis of the snowboard attachment of FIG. 21A.
Figure 21A:
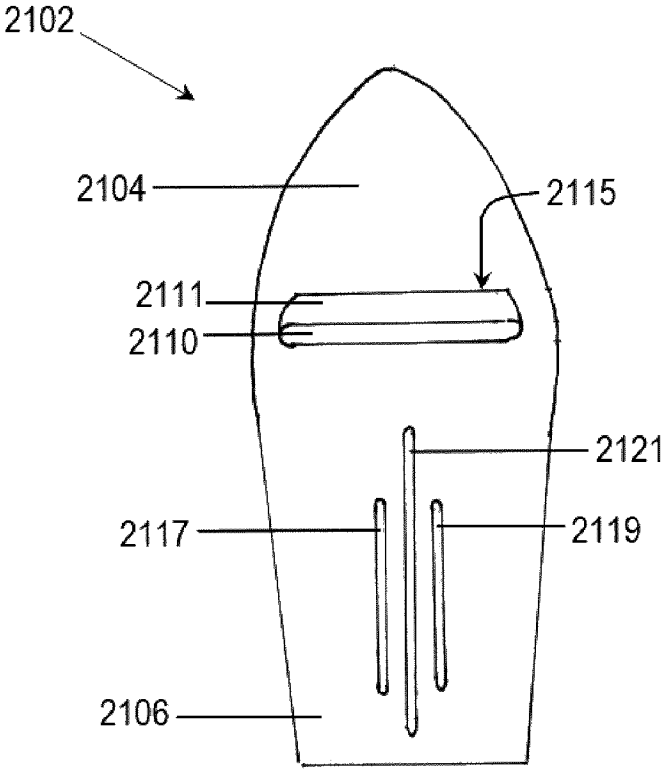
Referring to FIG. 21A, there is provided a view from above of a snowboard attachment, in accordance with the first embodiment of the present disclosure.
Figure 21D:
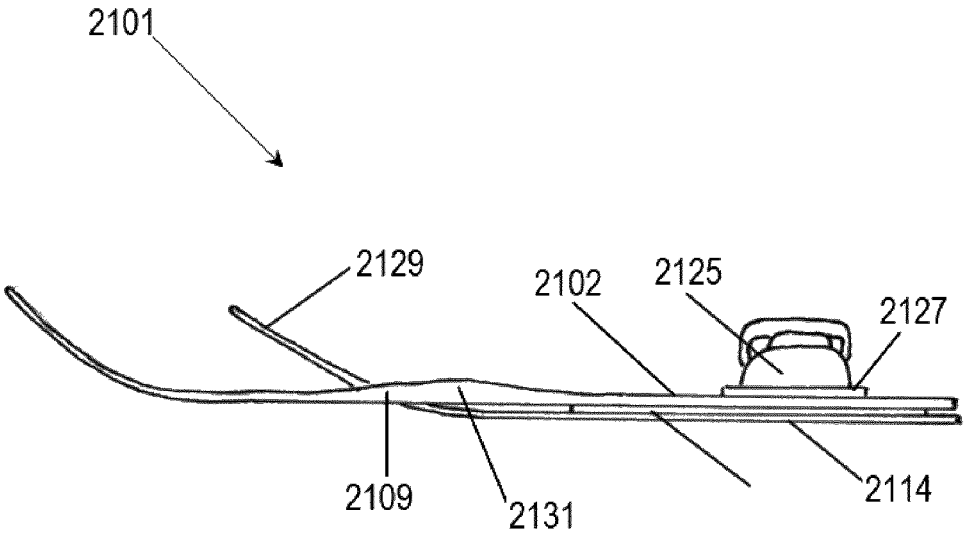
Referring to FIG. 21D, there is provided a side view of part of an assembly of part of a snowboard attachment and part of a standard snowboard, similar to the examples of FIG. 21A-21C, but the snowboard attachment has a thickened region.

FIG. 21A shows a view from above of an example of a snowboard attachment 2102, and FIG. 21B shows a vertical cross section through the longitudinal axis of the snowboard attachment. FIG. 21C shows a view from below of a similar snowboard attachment. The snowboard attachment 2102 has a nose part 2104, a body part 2106, and an elongate passage 2109 comprising openings 2110, 2112 through the top and bottom faces of the snowboard attachment respectively. The nose part 2104 is mitre-shaped and curved upwards from the horizontal towards the front, similar to snowboards specially built for running on powder snow. The opening is in the shape of an oblong with rounded corners, and extends transverse to the longitudinal axis of the snowboard attachment. The orientation of the elongate passage 2109 can be seen more clearly in the cross section, as it is slanted upwards towards the front. Thus, the front wall 2111 of the elongate passage extends to the opening in the top face of the snowboard attachment to line 2115. The back wall 2113 extends similarly with respect to the bottom face of the snowboard. The line 2115 and the corresponding line for the back wall are shorter than the width of opening 2109, to reduce the amount of material cut away in providing the elongate passage. The body part 2106 has through slots 2117, 2119, aligned parallel to the longitudinal axis. These slots accommodate standard binding clamp bolts in chosen positions along their lengths to suit the rider, and are typically spaced apart by 2 cm to 4 cm along the longitudinal axis of the snowbard or snowboard attachment. The positioning of the slots on the snowboard attachment may be optimised to fit with all different types of through slots of snowboards. There may also be an arrangement where there are male and female means between the snowbard attachment and snowboard alone or together with normal binding slots allowing to improved strength of the. The body part 2106 has a third through slot 2121, aligned with the longitudinal axis and slightly longer than the other two through slots, to accommodate a different type of binding clamp. Optionally, rubber pads 2123 may be fixed to the bottom face of the snowboard attachment for better grip with a standard snowboard. The rubber pads may be of Neoprene, favourably compounded to a Shore A hardness of no more than 80. The rubber pads may in an alternative embodiment be natural rubber with a hardness in the range of Shore A ca 50 to ca 70. In this example, there are two comb-shaped pads 2123 with slots to reveal slots 2117, 2119. FIG. 21D shows a side view of part of an assembly 2101 of part of a snowboard attachment 2102 and part of a standard snowboard 2114. The remainder of the assembly is truncated at the right-hand end of the figure. A front boot 2125 (pointing towards the viewer) is attached to the standard snowboard 2114 via a baseplate 2127. The base plate 2127 is attached to the standard snowboard 2114 and the part of the snowboard attachment, by bolts (not shown) that are standard for connecting the baseplate 2127 to the standard snowboard 2102. The nose tip 2129 of the standard snowboard passes through an elongate passage 2109. A rubber pad 2123 is attached to the snowboard attachment 2102, clamped to the standard snowboard 2114 by the binding clamp. In a preferred example of FIG. 21, shown in FIG. 21D, the snowboard attachment 2102 is of increased in thickness in a thickened region 2131 adjacent ends of the elongate passage 2109.

Figure 22:
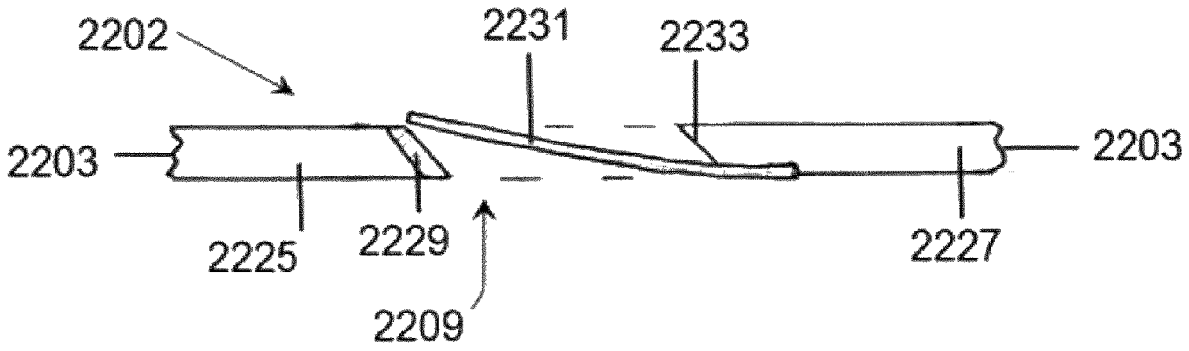
Referring to FIG. 22, there is provided a vertical cross section through part of a snowboard attachment, in accordance with another example of the first embodiment of the present disclosure.

FIG. 22 shows a vertical cross section through part of a snowboard attachment 2202 delimited by wavy lines 2203, showing a front portion 2225 and a back portion 2227 of the part shown. An elongate passage 2209 slants upwards towards the front. The front wall of the elongate passage has a rubber bush 2229 attached to it, extending substantially across the width of the front wall, preferably to correspond with regions of the front wall that would be in contact with a standard snowboard in use. A rubber flap 2231 is attached at one end to the back portion 2227 at the lower end of the back wall 2233 of the elongate passage 2209, while the other end hangs free. Optionally, part of the bottom face of the snowboard attachment may be cut away to accommodate the rubber flap 2231 and provide a surface for bonding it. The rubber flap may be of oblong shape and extend substantially across the width of the front wall, preferably to correspond with regions of the front wall that would be in contact with a standard snowboard in use. It may extend up to the front wall, or short of the front wall, or extend over or under the front wall.

Figure 23:
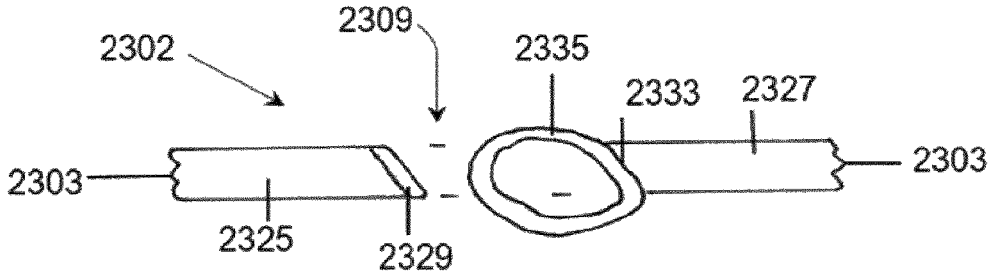
Referring to FIG. 23, there is provided a vertical cross section through part of a snowboard attachment, in accordance with a further example of the first embodiment of the present disclosure.

FIG. 23 shows a vertical cross section through part of a snowboard attachment 2302 delimited by wavy lines 2303, showing a front portion 2325 and a back portion 2327 of the part shown, an elongate passage 2309 and a rubber bush 2329, all similar to FIG. 22. However, instead of rubber flap 2331, there is a rubber tube 2335 shown end on. The rubber tube 2335 is adhered to the back wall 2333 of the elongate passage. The rubber tube may be inflated or filled with a soft material e.g. a foam, or be discontinuous about its circumference. The positioning and dimensions of the free hanging part of the rubber tube may be similar to those of the rubber flap in FIG. 22. The rubber flap 2331 and/or rubber tube 2335 are arranged to prevent the snow coming in through the slot and/or any gaps between the snowboard attachment and the snowboard while skiing. The rubber flap(s) 2331 and one or tube(s) 2335 can be used with all types of snowboard attachments no matter the width or slots of the snowboard as will stop the snow from coming through any gaps between the snowbard attachment and snowboard.

Figure 24:
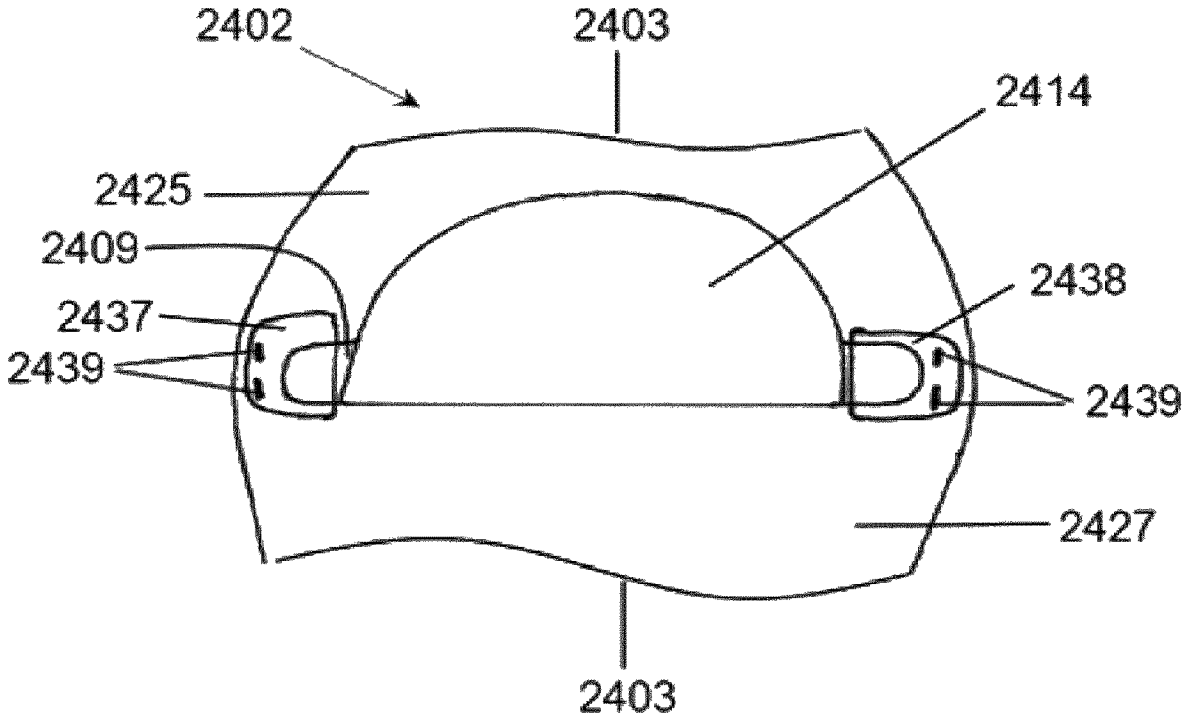
Referring to FIG. 24, there is provided a view from above of part of a snowboard attachment, in accordance with a yet further example of the first embodiment of the present disclosure.

FIG. 24 shows a view from above of part of a snowboard attachment 2402 delimited by wavy lines 2403 with the nose of a standard snowboard 2414 protruding through the elongate passage 2409. The snowboard attachment 2402 is similar to that shown in FIG. 22, without the rubber tube, flap or bush. The front portion 2425 and back portion 2427 of the part are shown. Over the sides of the elongate passage 2409, rubber lips 2437, 2438 are stapled in place by staples 2439. The rubber lips reduce the amount of snow that can pass though the elongate passage. The skilled person would recognize that a rubber bush, rubber tube and/or rubber flap could be incorporated in addition to the rubber lips.

Figure 25C:
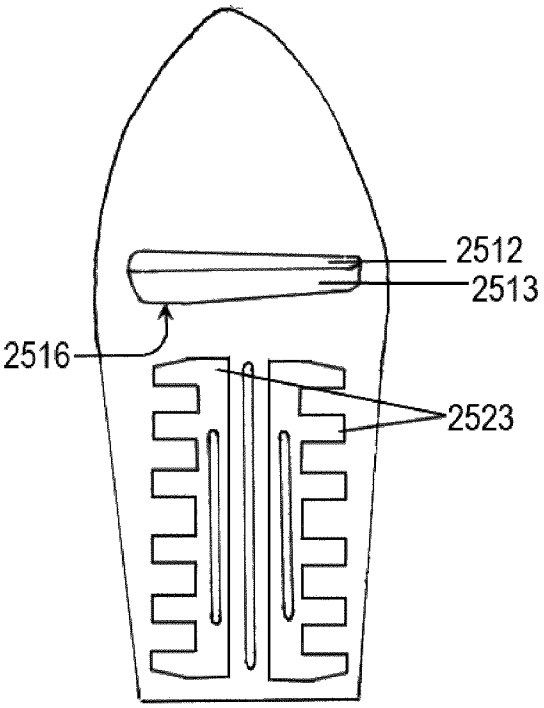
Referring to FIG. 25A, there is provided a view from above of part of a snowboard attachment, in accordance with a still further example of the first embodiment of the present disclosure.
Referring to FIG. 25B, there is provided a vertical cross section through the longitudinal axis of the snowboard attachment of FIG. 25A; and Referring to FIG. 25C, there is provided a view from below of a snowboard attachment, in accordance with the first embodiment of the present disclosure, similar to the example of FIG. 25A-B but with rubber pads.
Figure 25B:
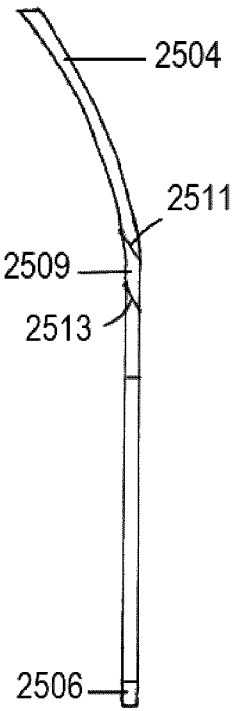
Figure 25A:
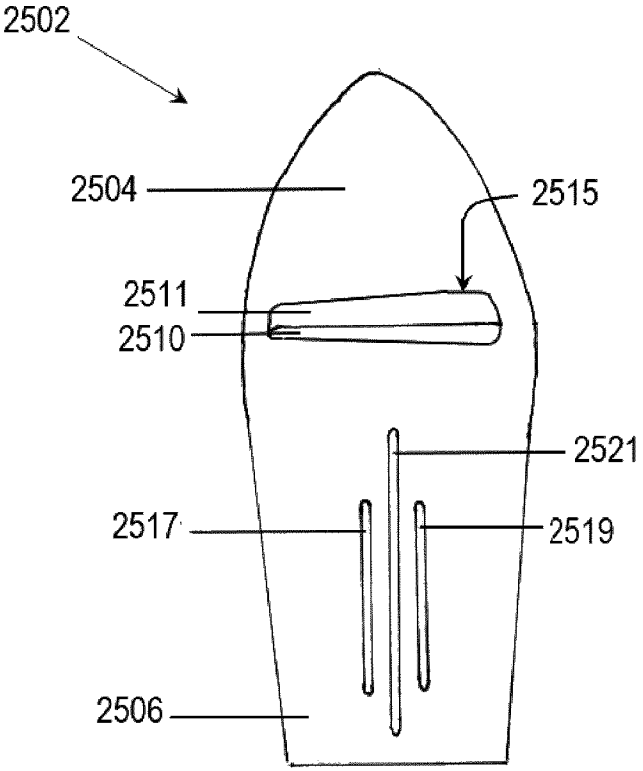

FIG. 25A shows a view from above of an example of a snowboard attachment 2502, and FIG. 25B shows a vertical cross section through the longitudinal axis of the snowboard attachment. FIG. 25C shows a view from below of a similar snowboard attachment. The snowboard attachment 2502 has a nose part 2504, a body part 2506, and an elongate passage 2509, comprising opening 2510, 2512 through the top and bottom faces of the snowboard attachment respectively. The nose part is mitre-shaped and curved upwards from the horizontal towards the front, similar to snowboards specially built for running on powder snow. The opening 2510 is elongate with rounded corners, and flares slightly towards the right in FIG. 25A. It extends transverse to the longitudinal axis of the snowboard attachment. The orientation of the elongate passage can be seen more clearly in the cross section, as it is slanted upwards towards the front. Thus, the front wall 2511 of the elongate passage extends to the opening in the top face of the snowboard attachment to line 2515. The back wall 2513 extends similarly with respect to the bottom face of the snowboard. The opening 2512 flares slightly to the left, and the elongate passage extends to the opening in the bottom face of the snowboard attachment to line 2516. The body part 2506 has through slots 2517, 2519, aligned parallel to the longitudinal axis. These slots accommodate standard binding clamp bolts in chosen positions along their lengths to suit the rider, and are typically spaced apart by 2 cm. The body part 2506 has a third through slot 2521, aligned with the longitudinal axis and slightly longer than the other two through slots, to accommodate a different type of binding clamp. Optionally, rubber pads 2523 may be fixed to the bottom face of the snowboard attachment for better grip with a standard snowboard. The rubber pads may be of Neoprene, favourably compounded to a Shore A hardness of no more than 80. In this example, there are two comb-shaped pads 2523 with slots to reveal slots 2517, 2519.

Modifications to embodiments of the present disclosure described in the foregoing are possible without departing from the scope of the present disclosure as defined by the accompanying claims. Expressions such as "including", "comprising", "incorporating", "have", "is" used to describe and claim the present disclosure are intended to be construed in a non-exclusive manner, namely allowing for items, components or elements not explicitly described also to be present. Reference to the singular is also to be construed to relate to the plural.

The invention claimed is:

1. A snowboard attachment for a standard snowboard, for riding under powder snow conditions, the snowboard attachment comprising:

a nose part that is operable to attach to the standard snowboard for providing lift and float while riding on powder snow;

an elongate passage in the snowboard attachment having walls extending between an opening in a top surface of the snowboard attachment and an opening in a bottom surface of the snowboard attachment, said elongate passage being orientated transverse to a longitudinal axis of the snowboard attachment and having walls configured to surround the standard snowboard; and a body part that is attached in operation to the nose part, wherein the body part has clamp through openings arranged to receive fastenings of a binding clamp of the standard snowboard, such that the clamp through openings lie in operation between the binding clamp and the standard snowboard.

2. The snowboard attachment according to claim 1, wherein the elongate passage passes through the nose part of the snowboard attachment.

3. The snowboard attachment according to claim 1, wherein the clamp through openings comprise slots aligned parallel to the longitudinal axis of the snowboard attachment.

4. The snowboard attachment according to claim 1, wherein the walls of the elongate passage through the snowboard attachment include a front wall and a back wall that are each orientated transverse to the longitudinal axis of the snowboard attachment, said front and back walls being aligned substantially parallel to each other and angled upwardly with respect to the forwards direction.

5. The snowboard attachment according to claim 1, wherein the sides of the snowboard attachment adjacent ends of the elongate passage are made with a dense hardwood.

6. The snowboard attachment according to claim 1, wherein snowboard attachment body part has regions thicker than regions of the snowboard attachment nose part.

7. The snowboard attachment according to claim 1, wherein the sides of the snowboard attachment adjacent ends of the elongate passage are thicker than other regions of the snowboard attachment.

8. The snowboard attachment according to claim 1, the snowboard attachment having a bottom surface, wherein rubber seal material is attached to the bottom surface.

9. The snowboard attachment according to claim 1, further comprising a strap to provide additional binding of the snowboard attachment to the standard snowboard.

10. A snowboard attachment for a standard snowboard, for riding under powder snow conditions, the snowboard attachment comprising:

a nose part operable to attach to the standard snowboard for providing lift and float while riding on powder snow and further comprising a first part and a second part attached in operation to each other by first attachment means and adjusted in operation to fit with a nose of the standard snowboard;

a body part that is attached in operation to the nose part, wherein the body part comprises a first connecting part and a second connecting part, and is placed in operation beneath the standard snowboard;

a first arm that comprises a first end and a second end opposite to the first end, wherein the first end of the first arm is attached in operation to the first connecting part;

a second arm that comprises a first end and a second end opposite to the first end, wherein the first end of the second arm is attached in operation to the second connecting part, wherein the first arm and the second arm are bent in operation around the standard snowboard to grip a top of the standard snowboard; and an auxiliary attachment means selected from a strap, a rubber grip, a rubber strap, a rubber pocket, a rubber hood, an elastic strap, a rubber band, a thumbscrew, a lever, a clip, a clamp, foam or magnets, that is attached in operation to the body part, for holding the snowboard attachment in place relative to the standard snowboard.

11. The snowboard attachment according to claim 10, wherein the auxiliary attachment means comprises a strap.

12. The snowboard attachment according to claim 10, wherein the body part is attached in operation to the nose part by second attachment means to provide a setback stance to a rider of the standard snowboard when the snowboard attachment is attached in operation with the standard snowboard.

13. The snowboard attachment according to claim 12, wherein the first arm and the second arm are attached in operation to the body part by third attachment means, wherein the first arm and the second arm are adjusted in operation to grip the top of the standard snowboard.

14. The snowboard attachment according to claim 13, wherein the second end of the first arm and the second end of the second arm are each attached with a respective attachment edge by fourth attachment means to respective edges of the standard snowboard in operation to allow the attachment edge to be in the same plane as edges of the standard snowboard.

15. The snowboard attachment according to claim 10, wherein the second end of the first arm and the second end of the second arm comprise a notch to grip in operation the standard snowboard.

16. The snowboard attachment according to claim 11, wherein the strap includes a plurality of flexible hook-like projections of a first component that are operable to engage onto a corresponding matting material of a second component to secure the strap, and wherein the strap is user-removable by elastically deforming the flexible hook-like projections of the first component from the matting material of the second component.

17. The snowboard attachment according to claim 10, wherein each of the first arm and the second arm are joined to the body part by a hinge.

18. The snowboard attachment according to claim 17, wherein the hinge comprises a thumbscrew configured to set the hinge rigidly into a position in operation.

19. The snowboard attachment according to claim 10, wherein the nose part further comprising a ramp configured to support in operation the nose of the standard snowboard.

20. The snowboard attachment according to claim 10, wherein the nose part further comprising a hood configured to contain the nose of the standard snowboard.

* * * * *